US006071611A

United States Patent [19]

Ohta et al.

[11] Patent Number: 6,071,611

[45] Date of Patent: Jun. 6, 2000

[54] SHEET FOR PROVIDING INK-RECEIVING LAYER

[75] Inventors: Tetsuzi Ohta, Mitaka; Yuichiro Yoneyama, Mie-ken; Takayuki Aikawa, Hannou, all of Japan

[73] Assignee: Kimoto Co., Ltd., Japan

[21] Appl. No.: 08/769,669

[22] Filed: Dec. 19, 1996

[30] Foreign Application Priority Data

Dec. 26, 1995 [JP] Japan ..... 7-351599

[51] Int. Cl.[7] ..... B41M 5/00

[52] U.S. Cl. ..... 428/343; 428/195; 428/355 EN

[58] Field of Search ..... 428/522, 480, 428/195, 343, 355 EN

[56] References Cited

U.S. PATENT DOCUMENTS

| | | | |
|---|---|---|---|
| 4,624,985 | 11/1986 | Tsutsumi et al. | 524/803 |
| 5,006,502 | 4/1991 | Fujimura et al. | 428/195 |
| 5,314,862 | 5/1994 | Hirota et al. | 428/195 |
| 5,795,425 | 8/1998 | Brault et al. | 156/235 |

FOREIGN PATENT DOCUMENTS

| | | |
|---|---|---|
| 62-21835 | 5/1987 | Japan . |
| 63-172784 | 7/1988 | Japan . |
| 8207426 | 8/1996 | Japan . |

*Primary Examiner*—Pamela R. Schwartz
*Attorney, Agent, or Firm*—Lorusso & Loud

[57] ABSTRACT

A sheet for providing an ink-receiving layer comprising a peelable substrate provided with an ink-receiving layer and an adhesive layer laminated thereon in this order or a sheet for providing an ink-receiving layer comprising a peelable substrate provided with an adhesive layer laminated thereon, which adhesive layer has ink-receiving property. These sheets can by a simple operation provide an ink-receiving layer on a material which has little or no ink-receiving property with respect to oil or aqueous inks

10 Claims, No Drawings

SHEET FOR PROVIDING INK-RECEIVING LAYER

BACKGROUND OF THE INVENTION

The present invention relates to a sheet for providing an ink-receiving layer, which can by a simple operation provide an ink-receiving layer on a material which has little or no ink-receiving property with respect to oil or aqueous inks.

For printing with various kinds of printing inks, various recording sheets each having ink-receiving property suitable for a particular printing ink have hitherto been used. Such a recording sheet is generally produced by applying an ink-receiving layer coating solution on a substrate and drying the coated layer by heating to form an ink-receiving layer.

However, depending on the nature of the material used for the substrate, this process comprising coating and heat-drying cannot be used. The process cannot be used, for example, with polyvinyl chloride sheets, which exhibit heat shrinkage at a temperature as low as 50 to 60° C., or with thermosensitive paper.

Therefore, the object of the present invention is to solve the problem described above, i.e., to provide a sheet for providing an ink-receiving layer on a substrate of any material, including those mentioned above, by transfer of an ink-receiving layer.

DESCRIPTION OF THE INVENTION

The present invention provides a sheet for providing an ink-receiving layer comprising a peelable substrate provided with an ink-receiving layer and an adhesive layer laminated thereon in this order.

The substrate used for the sheet of the present invention may be a transparent or opaque sheet. For example, it may be a synthetic resin film made of a polyester, polycarbonate, polypropylene, triacetylcellulose, polyvinyl chloride, acrylic resin, polystyrene, polyamide, polyimide or the like.

The surface of the substrate to be laminated with the ink-receiving layer may be subjected to an easy release treatment to improve its release property with respect to the ink-receiving layer. Such a treatment can be performed in a conventional manner, for example, by coating the surface with a release material such as a silicone resin, polyurethane resin or silicone-modified polyurethane resin.

When the substrate has a small thickness, the surface of the substrate opposite to the one provided with the ink-receiving layer may be provided with a back coat layer to prevent curling of the sheet. The substrate generally has a thickness of about 4 to about 250 $\mu$m.

The ink-receiving layer is laminated on the substrate and it may be composed of one or more layers having ink-receiving property. The ink-receiving layer may be mainly composed of water-soluble polymers. The ink-receiving layer may further contain other polymers, for example, water-soluble polymers made water-resistant or water-insoluble polymers, and additives such as extender pigments, ultraviolet absorbers, antioxidants and leveling agents and the like as required.

Examples of water-soluble polymers are synthetic resins such as polyvinyl alcohols, polyvinylpyrrolidones, hydroxycelluloses, melamine resins and copolymers of acrylic acid, acrylates and acrylamide and natural resins such as gelatin, casein, starch, chitin and chitosan.

Examples of water-soluble polymers made water-resistant are water-soluble polymers made water-resistant by introducing ionic bonds, coordinate bonds, covalent bonds, or hydrogen bonds through chemical reaction. Water-soluble resins used for preparing the water-soluble polymers made water-resistant may be selected from those mentioned above.

Examples of water-insoluble polymers include styrene/maleic acid copolymers, vinyl chloride/vinyl acetate copolymers, acrylic resins, cellulosic resins, polyvinyl acetals and the like.

The ink-receiving layer thickness is generally sufficient in a range of about 2 to about 30 $\mu$m.

The adhesive layer is laminated on the ink-receiving layer and it may be composed of any of various adhesives, for example, an adhesive having adhesiveness at room temperature, a hot melt type adhesive not adhesive at room temperature but becomes adhesive by heating during transfer, a delayed tack type adhesive not adhesive at room temperature but is made adhesive by heating before transfer, or the like. In particular, when the substrate on which the ink-receiving layer is formed is made of a material having poor heat-resistant property such as polyvinyl chloride, which exhibits heat shrinkage at a temperature as low as 50 to 60° C., an adhesive having adhesiveness at room temperature or a delayed tack type adhesive is preferably used. By using one of these materials, the ink-receiving layer may be formed even on a material which cannot be subjected to a heat treatment. The delayed tack type adhesives are particularly preferably used, because they do not require a separator referred to later and are free of the problem of paper jamming due to oozing of the adhesive during printing after the formation of the ink-receiving layer.

The adhesives mentioned above usually comprise a thermoplastic resin and a plasticizer. Examples of the thermoplastic resin include, for example, vinyl acetates, acrylic resins, polystyrenes, polyamides, alkyd resins, polycyanoacrylates, polyesters, phenoxy resins, polysulfones, polyallylsulfones, polyethylenes, poly(meth) acrylates, styrene/(meth)acrylate copolymers, styrene/butadiene copolymers, styrene/isoprene block copolymers, ethylene/vinyl acetate copolymers, vinyl acetate/(meth) acrylate copolymers, ethylene/vinyl chloride copolymers, ethylene/(meth)acrylate copolymers, ethylene/(meth)acrylic acid copolymers, vinyl chloride/vinylidene chloride copolymers, polybutadienes, urethane resins, vinylpyrrolidone/styrene copolymers and vinylpyrrolidone/(meth)acrylate copolymers. These thermoplastic resins may be used alone or in any combination thereof.

Those resins can be used for all of the adhesive types, i.e., the adhesive having adhesiveness at room temperature, the hot melt type adhesive and the delayed tack type adhesive. Whether a certain resin exhibits adhesion even at room temperature or only after heating generally depends on its molecular weight. An ordinary artisan in the art will be able to select a suitable molecular weight for a specific resin such as those resins mentioned above in order to obtain a desired adhesive type.

The delayed tack type adhesives comprise crystalline plasticizers as the plasticizer in addition to the thermoplastic resins. The crystalline plasticizers are solid at room temperature and hence do not plasticize the resins. However, when they are melted by heating, they can swell or soften the resins. Thus, when an adhesive layer comprising a delayed tack type adhesive, which layer is not adhesive at room temperature, is heated, the plasticizer acts to make the adhesive layer adhesive. Because this adhesiveness is maintained for several days, the adhesive layer can be made adhesive beforehand by heating, and the overlaying operation can be performed without, for example, a heat laminator, to advantageously improve the efficiency of the operation.

Examples of the crystalline plasticizer are, for example, diphenyl phthalate, dicyclohexyl phthalate, dihexyl phthalate, dihydroabietyl phthalate, dimethyl isophthalate, sucrose benzoate, ethylene glycol dibenzoate, trimethylolethane tribenzoate, tribenzoic acid glyceride, pentaerythritol tetrabenzoate, sucrose octaacetate, tricyclohexyl citrate, N-cyclohexyl-p-toluenesulfonamide and the like. The crystalline plasticizer preferably has a melting point between 50 and 100° C. If it has a melting point lower than 50° C., its adhesive property is not so different from that of ordinary adhesives, since the melting point is too close to room temperature. On the other hand, if its melting point is higher than 100° C., it becomes difficult to handle during heating.

The crystalline plasticizer is generally used in an amount of 30 to 300 parts by weight, preferably in an amount of 50 to 150 parts by weight, per 100 parts by weight of the thermoplastic resin. An amount in this range can produce the adhesiveness of the resins with high efficiency.

When the adhesive is of the delayed tack type, the adhesive may contain a tackifier in addition to the components mentioned above in order to improve its initial or residual adhesiveness. Examples of the tackifier, which should be selected depending on the nature of the thermoplastic resin to be used, include rosin resins and derivatives thereof, butyral resins, polyisobutylenes, acrylonitrile copolymer resins, aliphatic petroleum resins, aromatic petroleum resins, terpene resins, phenol resins, terpene/indene resins, xylene resins and the like. The tackifier is preferably used in an amount of 10 to 150 parts per 100 parts by weight of the thermoplastic resin. An amount of the tackifier in this range can provide sufficient initial adhesiveness but does not produce adhesiveness at room temperature.

A thickness within a range of about 1 to about 10 $\mu$m is sufficient for the adhesive layer of the sheet of the present invention, which is constituted of the various components mentioned above.

When the thermoplastic resin used for the adhesive layer is a water-soluble resin such as a polyvinyl alcohol modified with sulfone groups, polyvinyl alcohol modified with acetoacetyl groups, cross-linked polyethylene oxide, ethylene/vinyl alcohol copolymer and water-soluble polyester, an ink-receiving property for ink-jet printing is provided without the ink-receiving layer since such a thermoplastic resin itself is excellent in it's ink-receiving property for inks used for ink-jet printing. That is, a single layer can provide both the function of the adhesive layer and that of the ink-receiving layer for ink-jet printing when using such a special adhesive layer having such properties as mentioned above directly on the substrate.

Preferred among such hydrophilic thermoplastic resins are commercially available under the trade names of, for example, GOSELANL-0301, L-0302, GOSEFIMER LL-02, SOANOL, POLYESTAR WR-900, WR-901, XWR-930, XWR-950 (all products of Nippon Synthetic Chemical Industry Co., Ltd.), AQUACOKE (Sumitomo Seika Chemicals Co., Ltd.) and the like.

Other hydrophilic resins may also be added to the hydrophilic thermoplastic resin. As such hydrophilic resins, there can be mentioned natural resins such as albumin, gelatin, casein, starch, gum arabic and sodium alginate, carboxymethylcelluloses, hydroxyethylcelluloses, polyvinylpyrrolidones, polyamides, polyacrylamides, polyhydroxyethyl methacrylate, polyphenylacetoacetals, polyethyleneimines, polyvinyl alcohols, polyesters, sodium polyacrylates, acrylic acid ester copolymers and the like. These hydrophilic resins are preferably added in an amount of 1 to 100 parts by weight per 100 parts by weight of the hydrophilic thermoplastic resin. By using the hydrophilic resin in an amount of 1 part by weight or more with respect to 100 parts by weight of the thermoplastic resin, the ink-receiving property can be significantly improved, and an amount not more than 100 parts by weight can prevent reduction of the adhesiveness.

The sheet for providing an ink-receiving layer of the present invention having the structure described above is preferably produced by applying a coating solution for the ink-receiving layer comprising the water-soluble resin and the like dissolved or dispersed in a solvent such as water on a substrate by a conventional technique such as bar coating, drying the coated layer, then applying a solution for the adhesive layer and drying it in a similar manner and, if desired, laminating thereon a separator.

The already adhesive surface, or the surface not adhesive at room temperature, or the surface made adhesive by heating a surface of the adhesive layer not adhesive at room temperature, of the sheet for providing an ink-receiving layer produced as described above, is overlaid on a surface of any desired receiving material such as a non-heat-resistant polyvinyl chloride sheet, a wall or a metal plate and, if necessary, heat-pressed to adhere it to the material. The substrate is then peeled off. By such a process, the ink-receiving layer is transferred to and formed on the receiving material.

Printing can be performed on the ink-receiving layer after transfer onto the desired recieving material, or an already printed adhesive layer having ink-receiving property can be transferred onto the desired receiving material.

In particular, if an adhesive which is adhesive at room temperature or an adhesive of the delayed tack type is used, the heat-pressing for transfer of the ink-receiving layer can be omitted. Therefore, such a sheet is particularly preferably used for shrink films such as polyvinyl chloride sheets which shrink at a low temperature.

EXAMPLES

The present invention will be further explained with reference to the following examples. However, the present invention is not limited to the examples. In the examples, the expressions "part" and "%" mean "part by weight" and "% by weight", respectively, unless otherwise indicated.

Example 1

Coating solutions for an ink-receiving layer and an adhesive layer having the following compositions were successively coated on a polyester film having a thickness of 25 $\mu$m by bar coating to form an ink-receiving layer and an adhesive layer having dry thicknesses of 10 $\mu$m and 5 $\mu$m, respectively.

Coating Solution for Ink-Receiving Layer

- PVA (solids content, 100%; saponification degree, 71 to 75%;
- GOSENOL KP-06, Nippon Synthetic Chemical Industry Co., Ltd.) 3 parts
- PVA (solids content, 100%; saponification degree, 98 to 99%;
- GOSENOL NH-18, Nippon Synthetic Chemical & Industry Co., Ltd.) 2 parts Water 90 parts Coating Solution for Adhesive Layer Acrylic resin (solids content, 40%; SK DYNE 1502A70, Soken Chemical & Engineering Co., Ltd.) 30 parts Isopropyl alcohol 75 parts Example 2

An adhesive layer having a dry thickness of 5 μm was formed on an ink-receiving layer formed on a polyester film in the same way as in Example 1 by applying a coating solution for an adhesive layer having the following composition in the same way as in Example 1.

Coating Solution for Adhesive Layer

Ethylene/vinyl acetate copolymer (solids content, 46%; MOVINYL 730, Hoechst Gosei K.K.) 217.4 parts Crystalline plasticizer (solids content, 100%; dicyclohexyl phthalate) 125.0 parts Tackifier (solids content, 55%; rosin ester, SE-E-730-55, Arakawa Chemical Industries, Ltd.) 181.8 parts Water 125.0 parts Example 3

An adhesive layer having a dry thickness of 15 μm was formed on a polyester film the same as that in Example 1 by coating a coating solution for an adhesive layer having the following composition in a manner similar to that in Example 1.

Coating solution for adhesive layer

Ethylene/vinyl acetate copolymer (solids content, 46%; MOVINYL 730, Hoechst Gosei K.K.) 217.4 parts Crystalline plasticizer (solids content; 100%, dicyclohexyl phthalate) 125.0 parts Tackifier (solids content, 55%; rosin ester, SE-E-730-55, Arakawa Chemical Industries, Ltd.) 181.8 parts Hydrophilic resin (PVA, solids content; 100%, GOSENOL KH-17, Nippon Synthetic Chemical Industry Co., Ltd.) 10 parts Water 125.0 parts The adhesive layer of the sheet for providing an ink-receiving layer obtained in Example 1 was adhesive at room temperature and therefore could be adhered to a polyvinyl chloride sheet having a thickness of 50 μm by application without heating. Then, the polyester film was peeled off to leave only the ink-receiving layer. When printing was performed on the obtained ink-receiving layer of the sheet using an ink-jet printer (BJC600J, Canon Inc.), good printing was obtained.

Neither of the adhesive layers of the sheets for providing an ink-receiving layer obtained in Examples 2 and 3 were adhesive at room temperature. They were therefore maintained at 100° C. for 60 seconds to be made adhesive. Then, they were applied to polyvinyl chloride sheets having a thickness of 50 μm and adhered in the manner described above. Then, the polyester films were peeled off to leave only the ink-receiving layers. When printing was performed on the ink-receiving layers of the thus obtained sheets using an ink-jet printer (BJC600J, Canon Inc.), good printing results were obtained.

As explained above, an ink-receiving layer can easily be provided on a material having no ink-receiving property for ink-jet printing inks or on a material not having heat-resistance by using the sheet for providing an ink-receiving layer of the present invention.

What is claimed is:

1. A transfer sheet for transfer of an ink-receiving layer onto a receiving material, said transfer sheet comprising a peelable substrate and the ink-receiving layer, said ink-receiving layer being an adhesive layer laminated to said peelable substrate and separable therefrom upon being pressed against the receiving material, by peeling of the substrate, said adhesive layer being sufficiently hydrophilic to function as an ink-receiving layer in ink-jet printing, wherein said adhesive layer is a delayed tack adhesive and comprises at least a hydrophilic thermoplastic resin and a crystalline plasticizer which is solid at room temperature.

2. The transfer sheet of claim 1 additionally comprising a release layer between said peelable substrate and said ink-receiving layer.

3. The transfer sheet of claim 2 wherein said release layer is a resin selected from the group consisting of silicone resins, polyurethane resins and silicone-modified polyurethane resins.

4. The transfer sheet of claim 1 wherein said ink-receiving layer is adhesive at room temperature.

5. The transfer sheet of claim 1 wherein said ink-receiving layer comprises a water-soluble resin.

6. A transfer sheet for transfer of an ink-receiving layer onto a receiving material, said transfer sheet comprising a peelable substrate and the ink-receiving layer, said ink-receiving layer being an adhesive layer laminated to said peelable substrate and separable therefrom upon being pressed against the receiving material, by peeling of the substrate, said adhesive layer being sufficiently hydrophilic to function as an ink-receiving layer in ink-jet printing, wherein said adhesive layer is a delayed tack adhesive comprising a crystalline plasticizer which is solid at room temperature and one or more hydrophilic thermoplastic resins selected from the group consisting of polyvinyl alcohols modified with sulfone groups, polyvinyl alcohols modified with acetoacetyl groups, cross-linked polyethylene oxides, ethylene/vinyl alcohol copolymers and water-soluble polyesters.

7. The transfer sheet of claim 6 additionally comprising a release layer between said peelable substrate and said ink-receiving layer.

8. The transfer sheet of claim 7 wherein said release layer is a resin selected from the group consisting of silicone resins, polyurethane resins and silicone-modified polyurethane resins.

9. The transfer sheet of claim 6 wherein said ink-receiving layer is adhesive at room temperature.

10. The transfer sheet of claim 6 wherein said hydrophilic thermoplastic resin is water-soluble.

* * * * *